United States Patent [19]

Laurent

[11] Patent Number: 4,982,341

[45] Date of Patent: Jan. 1, 1991

[54] METHOD AND DEVICE FOR THE DETECTION OF VOCAL SIGNALS

[75] Inventor: Pierre A. Laurent, Bessancourt, France

[73] Assignee: Thomson CSF, Puteaux, France

[21] Appl. No.: 347,014

[22] Filed: May 4, 1989

[30] Foreign Application Priority Data

May 4, 1988 [FR] France ..... 88 06001

[51] Int. Cl.[5] ..... G10L 7/08

[52] U.S. Cl. ..... 364/517; 381/46; 381/47

[58] Field of Search ..... 364/517, 513.5, 574; 381/46, 47, 43

[56] References Cited

U.S. PATENT DOCUMENTS

| | | | |
|---|---|---|---|
| 4,359,604 | 11/1982 | Dumont | 381/43 |
| 4,672,669 | 6/1987 | Desblache | 381/46 |
| 4,700,392 | 11/1987 | Kato et al. | 381/46 |
| 4,700,394 | 10/1984 | Selbach et al. | 381/46 |
| 4,918,732 | 4/1990 | Gerson et al. | 381/46 |
| 4,920,568 | 4/1990 | Kamiya et al. | 381/46 |

FOREIGN PATENT DOCUMENTS

| | | | |
|---|---|---|---|
| 0140249 | 10/1983 | European Pat. Off. . | |
| 0167364 | 1/1986 | European Pat. Off. . | |
| 8703995 | 7/1987 | PCT Int'l Appl. | 381/46 |
| 2188763 | 10/1987 | United Kingdom | 381/46 |

OTHER PUBLICATIONS

IEEE International Conference on Communications, Jun. 12–15, 1977, Chicago, Ill., vol. 3, pp. 38.4–54–38-.4–56, IEEE, N.Y., U.S.A.; R. J. McAulay: "A Robust Silence Detector for Increasing Network Channel Capacity".

*Primary Examiner*—Kevin J. Teska
*Assistant Examiner*—Ellis B. Ramirez
*Attorney, Agent, or Firm*—Cushman, Darby & Cushman

[57] ABSTRACT

The method disclosed comprises the steps of: cutting up the signal into frames, sampling each frame to obtain a digital signal comprising a determined number n of samples, pre-emphasizing the digital signal, filtering the pre-emphasized digital signal by means of a high-pass digital filter to obtain a filtered digital signal, measuring, in each frame, the maximum energy of the pre-emphasized signal and the maximum energy of the filtered digital signal, to achieve an energy ratio R between the maximum energy of the filtered digital signal and the maximum energy of the pre-emphasized digital signal. The method also comprises the steps of computing, between two limits, the mean long-term values of the maximum value of the energy of the filtered signal and of the energy ratio and of computing, on the basis of the mean long-term values, four threshold values, two of them being maximum values, forming two lower limits of the speech state for the filtered signal and the energy ratio respectively, and two of them being minimum signals, forming two upper limits of the noise state for the filtered signal and the energy ratio respectively, to compare, with these threshold values, the maximum energy of the filtered signal and the energy ratio, to decide on the presence of the vocal signal in the noise-infested signal when the maximum energy of the filtered digital signal, or the energy ratio, is respectively greater than their maximum threshold values.

11 Claims, 7 Drawing Sheets

FIG_8-A
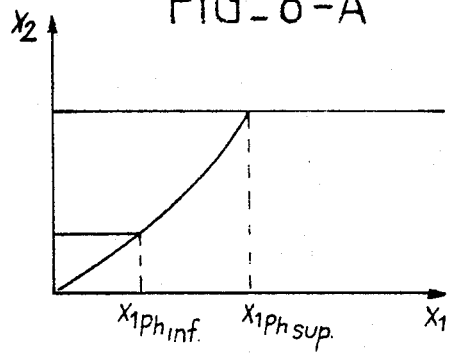
FIG_8-B
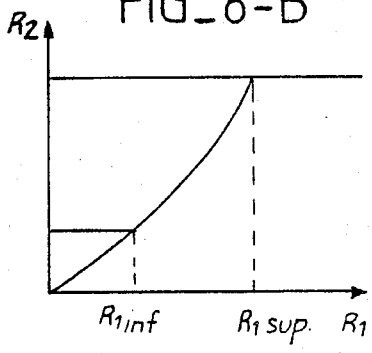
FIG_13
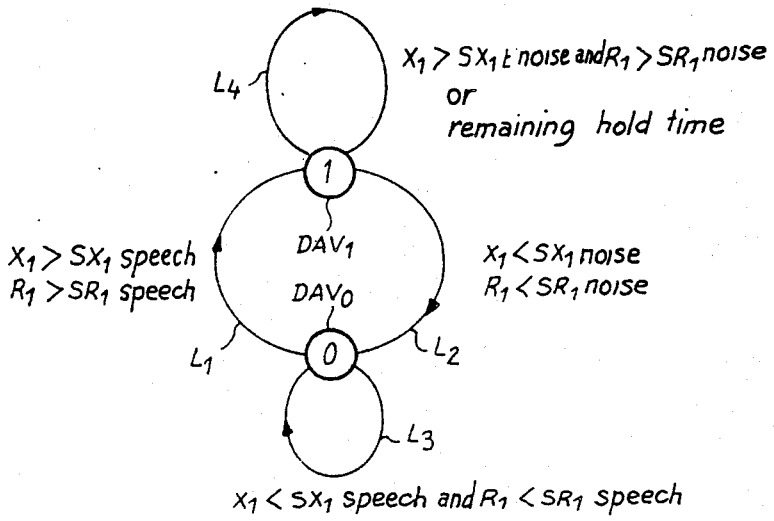
FIG_12
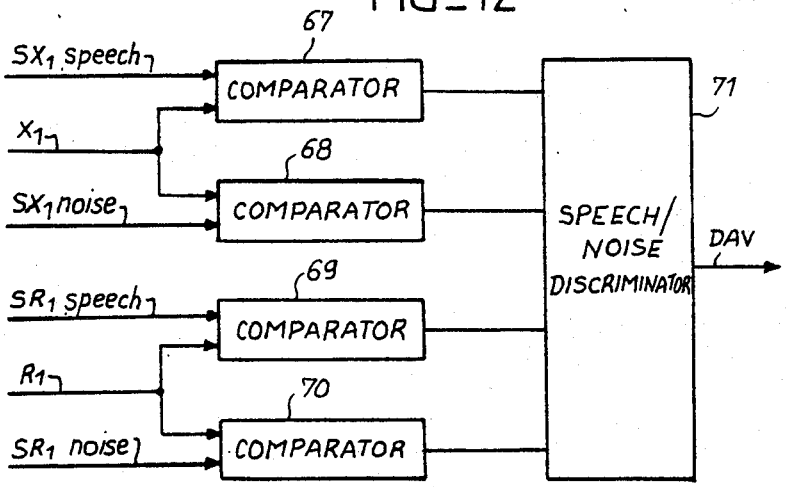

FIG_11-A
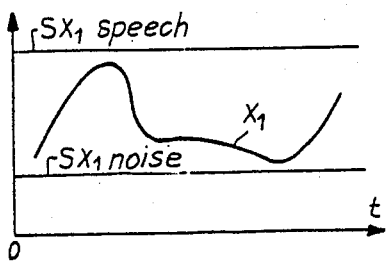
FIG_11-B
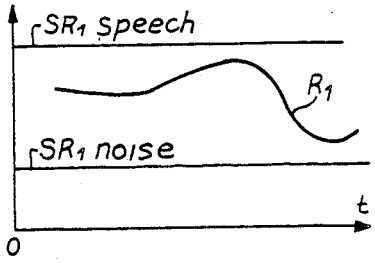
FIG_9
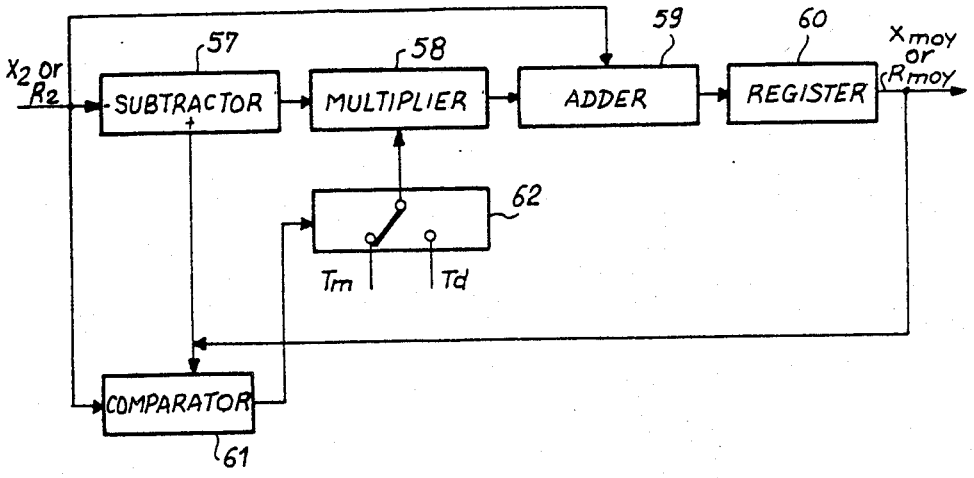
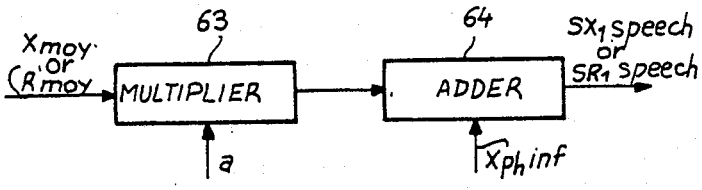
FIG_10-A
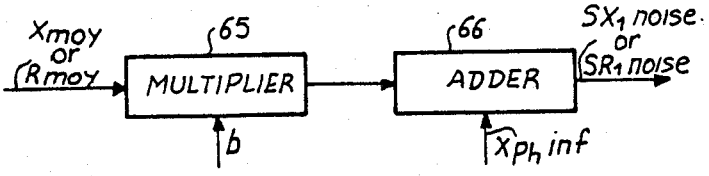
FIG_10-B

METHOD AND DEVICE FOR THE DETECTION OF VOCAL SIGNALS

BACKGROUND OF THE INVENTION

1. Field of the Invention

The present invention concerns a method and device for the detection of vocal signals which can be used, notably in alternate radio-electrical transmissions on board vehicles.

2. Description of the Prior Art

Most prior art detectors of vocal activity cannot work properly except for sufficiently high signal-to-noise ratios of the order of 20 dB at the minimum. This corresponds to working conditions in calm, office-type environments.

By contrast, on board a vehicle, the speech/noise discrimination has to take a far weaker signal-to-noise ratio, most usually lower than 10 dB, into account. Under certain conditions (high engine rate in a vehicle with average soundproofing, for example) the noise level may even exceed that of the signal.

Finally, the level and type of noise to be discriminated vary according to conditions inherent to the vehicle (the degree of soundproofing, for example) but also as a function of the route taken: a particularly unfavorable example is that of routes in cities where the noises to be taken into account are generally of a high level, are not stationary and are naturally highly varied.

An embodiment of a vocal activity detector designed to work in noisy environments is known from the patent application Ser. No. 79 74227 of 28th September, 1979, now U.S. Pat. No. 4,359,604 filed on behalf of the applicant. But this detector cannot be used to optimize speech/noise discrimination except for voiced sounds, and the decision is taken in comparing the vocal signal solely with a threshold voltage, this variable being automatically linked to the value of the peak amplitude of the vocal signal, without taking into account the real noise level. The result thereof is performance levels that do not suffice to enable proper operation in a highly disturbed environment where the speech signal is drowned in the noise.

SUMMARY OF THE INVENTION

An aim of the invention is to overcome the above-mentioned drawbacks. To this effect, an object of the invention is a method for the detection of a vocal signal in a signal drowned in noise, said method comprising the steps of:

cutting up the signal into frames;

sampling each frame to obtain a digital signal comprising a determined number n of samples;

pre-emphasizing the digital signal to obtain a pre-emphasized digital signal;

filtering the pre-emphasized digital signal by means of a high-pass digital filter to obtain a filtered digital signal;

measuring, in each frame, the maximum energy of the samples of the pre-emphasized signal and the maximum energy of the samples of the filtered digital signal;

achieving an energy ratio between the maximum energy of the samples of the filtered digital signal and the maximum energy of the samples of the pre-emphasized digital signal;

computing, between two limits, the mean long-term values of the energy of the samples of the filtered signal and of the energy ratio;

computing, on the basis of the mean long-term values, four threshold values, two of them being maximum values, forming two lower limits of the speech state for the filtered signal and the energy ratio respectively, and two of them being minimum signals, forming two upper limits of the noise state for the filtered signal and the energy ratio respectively, to compare the maximum energy of the filtered signal and the energy ratio with these threshold values;

deciding on the presence of the vocal signal in the noise-infested signal when the maximum energy of the filtered digital signal, or the energy ratio, is respectively greater than their maximum threshold values;

and deciding on the absence of a vocal signal in the noise-infested signal when the maximum energy of the filtered digital signal, or the energy ratio R, is respectively smaller than their minimum threshold values.

Another object of the invention is a device for the implementation of the above-mentioned method.

BRIEF DESCRIPTION OF THE DRAWINGS

Other features and advantages of the invention will appear below, from the following description, made with reference to the appended drawings, of which:

FIGS. 8A and 8B are two graphs showing the methods used to determine the thresholds represented in the steps 12 to 22 of FIG. 2.

FIG. 9 shows an embodiment of the device for the computation of the mean values $X_{moy}$ and $R_{moy}$ illustrated in the steps 12 to 22 of FIG. 2.

FIGS. 10A and 10B show two circuits for the computation of the threshold values according to the invention;

FIGS. 11A and 11B show two graphs to illustrate the mode of comparison by adaptive thresholds, according to the invention;

FIG. 12 shows an embodiment of the comparison device for the implementing of the steps 30 to 40 of FIG. 4.

FIG. 13 is a state diagram showing the decision algorithm that makes it possible to define whether a vocal signal is present or not in the voiced signal.

DETAILED DESCRIPTION OF THE INVENTION

The method according to the invention, illustrated in FIGS. 1 to 4, is an example of a practical implementation, made on signal frames infested with noise of about 20 milliseconds and sampled at a rate of 160 samples per frame to give signal samples S. As shown in the steps 1 to 5 of FIG. 1, the digital signal S on which the processing takes place is first pre-emphasized at the step 1 to give the signal samples Sn, and then filtered at the step 2 to give signal samples $S_{ph}(n)$ by a high-pass digital filtered with a cut-off frequency FC=1200 Hz. At the following steps 3 and 4, the following parameters:

$$x=\max(Sn)$$

and $X_{ph}=\max S_{ph}(n)$ are computed, n being between 1 and 160. These computations consist in seeking, in each sequence of samples S(n) and $S_{ph}(n)$, that sample which has the maximum amplitude or energy.

The step 5 consists in computing the ratio $R=X_{ph}/X$ between the two parameters $X_{ph}$ and X computed at the steps 3 and 4.

Figure 1:
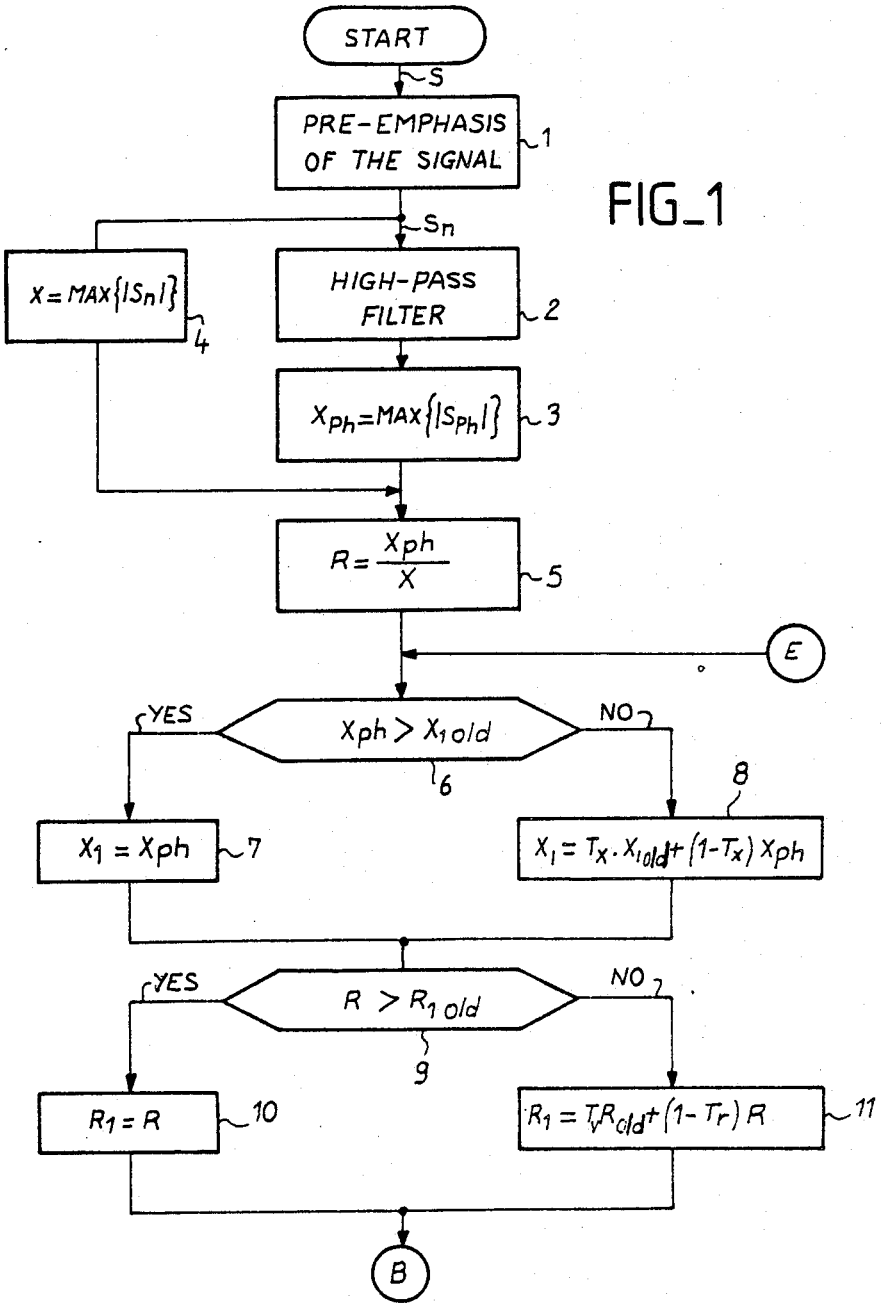
FIGS. 1 to 4 are flow charts illustrating the different steps of the method implemented by the invention.

The steps 6 to 11 that follow consist in the computation of the parameters X1 and R1 according to the relationships:

$X_1=X_{ph}$ if $X_{ph}$ is greater than the parameter $X_1$ computed at the preceding frame and designated by $X_{lold}$ in the FIG. 1;

$$\text{else } X_1=T_X\cdot X_{lold}+(1-T_x\cdot X_{ph});$$

$R_1=R$ if R is greater than the ratio R computed at the preceding frame and designated by $R_{old}$ in FIG. 1;

$$\text{else } R_1=T_rR_{lold}+(1-T_r)\cdot R.$$

Figure 2:
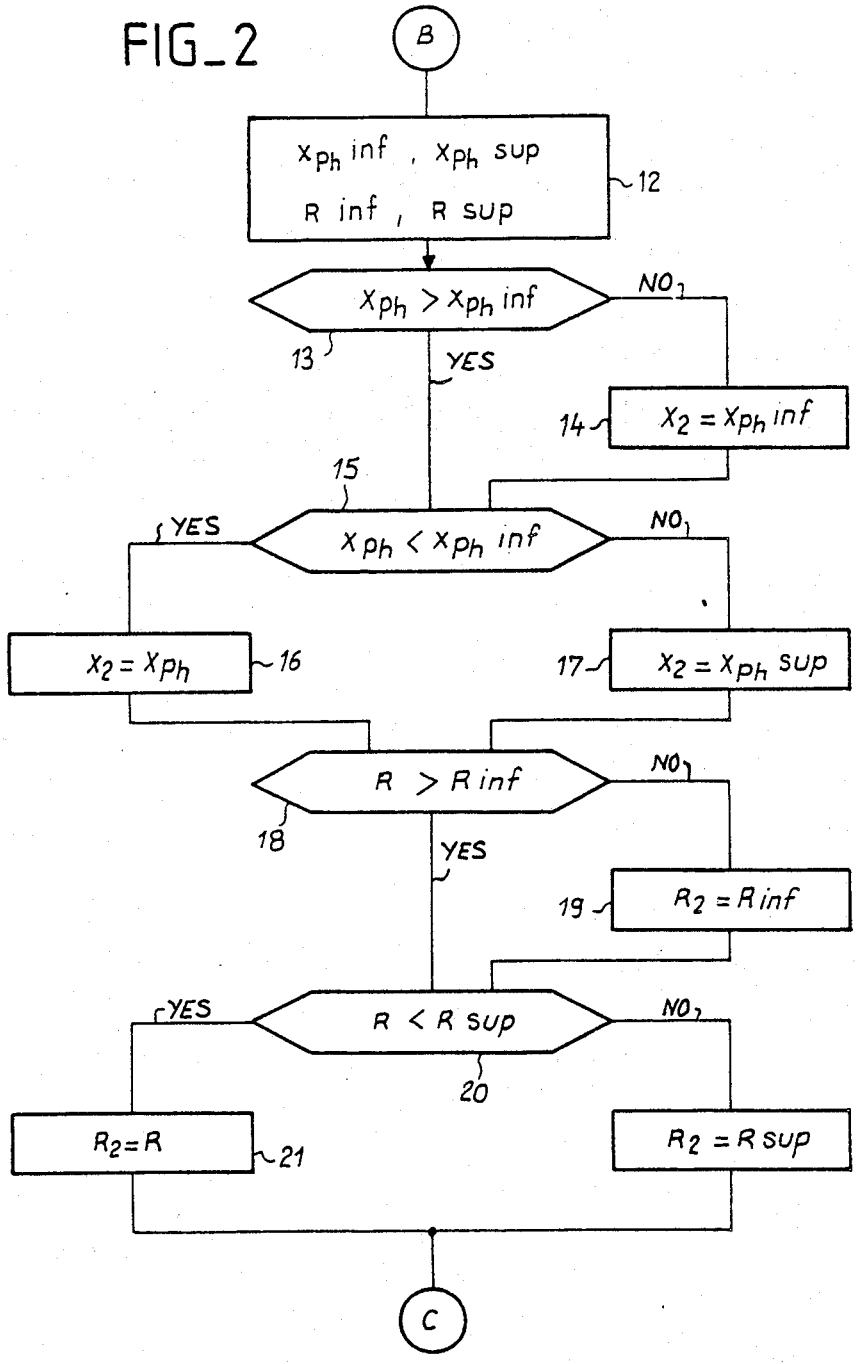
Figure 3:
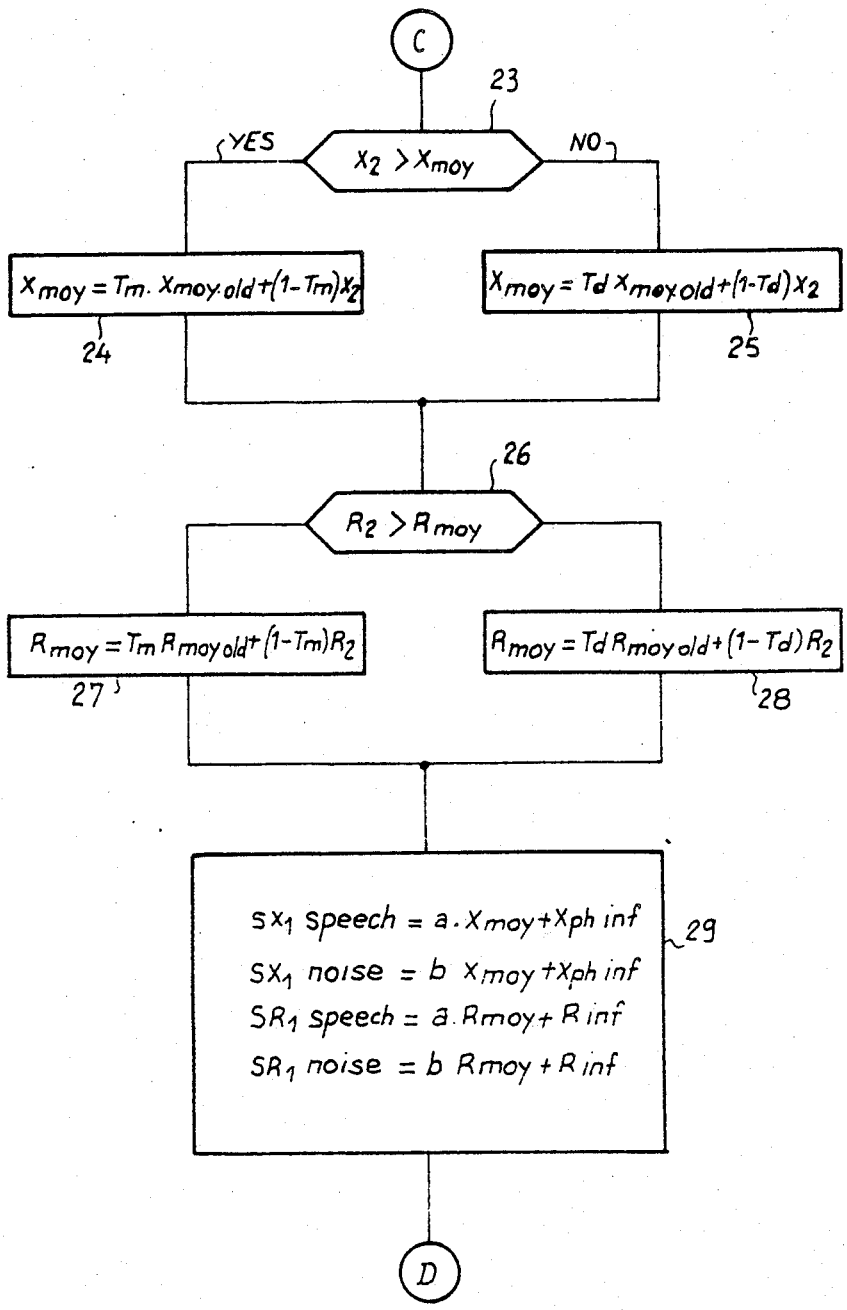

This enables an instantaneous growth to be permitted, from one frame to the next one, in the values of the parameters X1 and R1, whereas their decreasing would occur more slowly with time constants respectively equal to $T_X$ and $T_r$. According to a preferred embodiment of the invention, the value of the time constants is fixed at 0.75. This corresponds to about 70 milliseconds. The next steps 12 to 29, which are shown in FIGS. 2 and 3, consist in determining four detection thresholds, using the mean long-term value of the parameters $X_{ph}$ and R. The latter are firstly limited at the step 12 between constant, maximum and minimum values, so as to prohibit excessive variations in thresholds. The limits of variation of $X_{ph}$ and $R_2$ are referenced $X_{ph}$inf, $S_{ph}$sup, R.inf, R.sup. the steps 13 to 22 consist in the computation of two parameters $X_2$ and $R_2$ verifying the relationships:

$$X_2=\text{MAX}(\text{MIN}(X_{ph},X_{ph}\cdot\text{sup}),X_{ph}\cdot\text{inf})$$

$$R_2=\text{MAX}(\text{MIN}(R,\ R\cdot\text{sup}),R\cdot\text{inf})$$

The long-term mean values of the parameters $X_p$ and R, respectively marked $X_{moy}$ and $R_{moy}$, are computed at the steps 23 to 28 in applying the following relationships:

$$X_{moy}=T_m\cdot X_{moy\cdot old}+(1-T_m)\cdot X_2,$$

if $X_2$ is greater than the parameter $X_{moy}$ computed at the preceding frame and designated by $X_{moy\cdot old}$ in FIG. 3;

$$\text{else } X_{moy}=T_d\cdot X_{moy\cdot old}+(1-T_d)\cdot X_2.$$

$$R_{moy}=T_m\cdot R_{moy\cdot old}+(1-T_m)R_2$$

if $R_2$ is greater than the parameter $R_{moy}$ computed at the preceding frame and designated by $R_{moy\cdot old}$ in FIG. 3.

$$\text{else } R_{moy}=T_d\cdot R_{moy\cdot old}+(1-T_d)\cdot R_2.$$

In these relationships, the rising time constant $T_m$ provides for an exponentially slow rise, whereas the descending time constant $T_d$ enables a fast exponential rise so that the mean value considered quickly falls back to a level corresponding to the noise. The values of these time constants is, in the preferred embodiment of the invention, fixed at 0.95 for the rise, namely about 400 milliseconds, and 0.2 for the descent, namely about 13 milliseconds. Finally, the four values of thresholds are computed at the step 29, using the values Xmoy and Rmoy defined above by the relationships.

$$SX_1\text{ speech}=a\cdot X_{moy}+X_{ph}\cdot\text{inf}$$

$$SX_1\text{ noise}=b\cdot X_{moy}+X_{ph}\cdot\text{inf}$$

$$SR_1\text{ speech}=a\cdot R_{moy}+R\cdot\text{inf}$$

$$SR_1\text{ noise}=b\cdot R\text{ moy}+R\cdot\text{inf}$$

The values of the multiplier coefficients a and b are, in the preferred example of the invention, fixed at 1.8 and 1.25. It should be noted, besides, that if one of the parameters $X_{ph}$ or R is smaller than the corresponding lower limit, the decision relating to is taken automatically.

Figure 5:
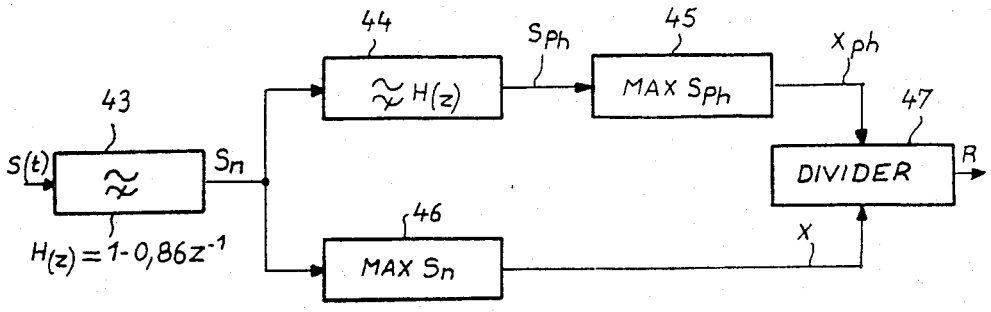
FIG. 5 shows a device for the computation of the energy ratio, implementing the steps 1 to 5 of the method according to the invention.

A device for computing the energy ratio, implementing the steps 1 to 5 of the method, is shown in FIG. 5. This device has a first filter 43, which is a high-pass filter, with a transfer function $H(z)=1-0.86\cdot z^{-1}$, that achieves a pre-emphasizing of the signal shown at the step 1. This filter is coupled, by its output, firstly to a second high-pass filter 44, having a cut-off frequency of about 1200 Hz and, secondly, to an energy computing device 46. The second high-pass filter 44 is also coupled, at its output, to an energy computing device 45, similar to the energy computing device 46. The filter 44 and the energy computing device 45 provide the parameter $X_{ph}$ in execution of the steps 2 and 3 of the method, and the energy computing device 46 gives the parameter X. The parameters X and $X_{ph}$ are respectively applied to a first operand input and a second operand input of a divider circuit 47 to compute the parameter R according to the step 5.

Figure 6:
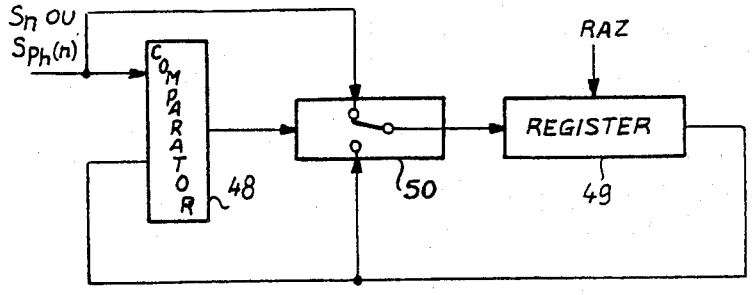
FIG. 6 shows an embodiment of a device for the computation of the value of the sample having the maximum energy in a frame of a filtered signal or of the pre-emphasized signal of FIG. 5.

An embodiment of the energy computing devices 45 and 46 is shown in FIG. 6. This circuit has the comparator circuit 48 coupled to a register 49 through a shunting circuit 50. The comparator circuit 48 has two inputs. A first input receives the signal samples S(n) given by the digital filter 43 or the signal samples given by the digital filter 44. The second input is connected to the output of the register 49. The shunt circuit 50 is controlled by the input of the comparator circuit 48 and shunts the signal samples S(n) or $S_{ph}$ to the input of the register 49 when the value of the signal sample S(n) or $S_{ph}(n)$ is greater than the content of the register 49. If not, the register 49 remains looped to itself.

Figure 7:
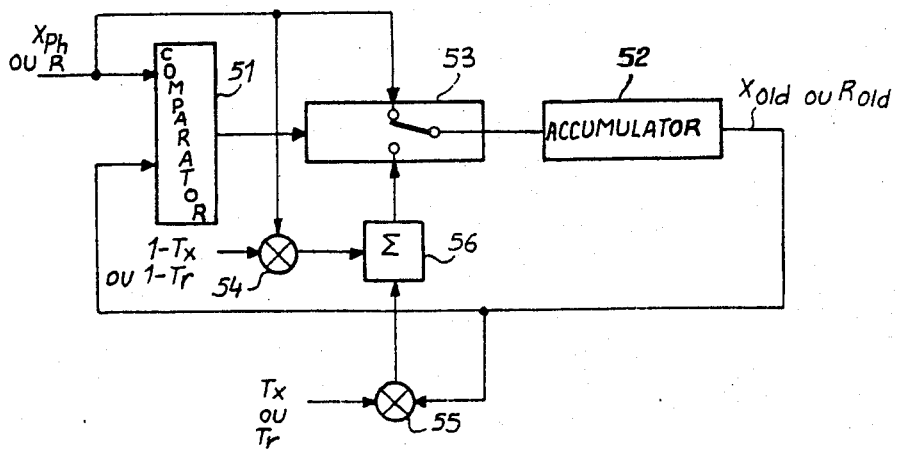
FIG. 7 shows an embodiment of a device for the implementation of the steps 6 to 11 of FIG. 1.

One embodiment of the device for implementing the steps 6 to 11 is shown in FIG. 7. This device has a comparator circuit 51, coupled to an accumulator circuit 52 through a shunt circuit 53. A multiplier circuit 54 is connected by a first operand input to a first input of the comparator circuit 51, and receives, at its second operand input, the parameters $1-T_X$ or $1-T_r$ represented in the steps 8 and 11 of the method. A second multiplier circuit 55 is connected by a first operand input of the output of the accumulator circuit 52, and it receives, at a second operand input, the parameters $T_X$ or $T_r$ represented in the steps 8 and 11 of the method. The outputs of the multiplier circuits 54 and 55 are respectively connected to a first operand input and a second operand input of an adder circuit 56, the output of which is connected to a first input of the shunt circuit 53. The output of the accummulator circuit 52 is further connected to the second operand input of the comparator circuit 51. According to the steps 6 to 11, the parameters $X_{ph}$ or R are applied to the first input of the comparator circuit 51 and are compared with the contents X·old or R·old of the accumulator circuit 52. If, according to the step 6 or the step 9, the parameters $X_{ph}$ or R are greater than the content X·old or R·old of the accumulator circuit 52, the shunt circuit 53 updates the content of the accumulator 52 by one of the parameters $X_{ph}$ or R according to the steps 7 and 10. If not, the shunt circuit 53 switches over the output of the adder circuit 56 to the input of the accumulator circuit 52, to update the content of the accumulator by the parameters X1 or R1 defined by the relationships described above, with respect to the steps 8 and 11. In these relationships, the product $(1-T_x)\times X_{ph}$ or the product $(1-T_r)\times R$ are performed by the multiplier circuit 64 and the products $T_X\times$X·old or $T_R\times$R·old are performed by the multiplier circuit 55. The sum of the product obtained is made by the adder circuit 56.

The steps 12 to 22 of the method shown in FIG. 2 are performed by means of threshold amplifiers (not shown), the characteristics of which are, however, shown in FIGS. 8A and 8B. These threshold amplifiers make it possible not to take into account the excessive values of the parameters $X_1$ and $R_1$. According to these characteristics, each parameter $X_1$ or $R_1$ is limited between two values $X_{1ph}$·inf and $X_{1ph}$·sup or $R_1$·inf and $R_1$·sup. These characteristics enable the generation of the parameters $X_2$ and $R_2$ according to linear relationships of the parameters $X_1$ and $R_1$ between the threshold values $X_{1ph}$·inf and $X_{1ph}$·sup or $R_1$·inf and $R_1$·sup, the parameters $X_2$ and $R_2$ being limited in amplitude for the values of the parameters $X_1$ and $R_1$ external to these thresholds.

One embodiment of a device for computing mean values $X_M$ or $R_M$, illustrated by the steps 23 to 28 of the method, is shown in FIG. 9. This device has, series-connected in this order, a substractor circuit 57, a multiplier circuit 58, an adder circuit 59 and a register 60. The subtractor circuit 57 has a first operand input to which the parameters $X_2$ or $R_2$ are applied, and a second operand input connected to the output of the register 60. The device also has a comparator circuit 61 with two inputs, respectively connected to the inputs of the subtractor circuit 57. The output of the comparator circuit 61 is connected to a control input of a shunt circuit 62. The shund circuit 62 has two inputs to which the time constants $T_m$ and $T_d$ are applied. The output of the shunt circuit 62 is connected to a first operand input of the multiplier circuit 58, the second operand input of the multiplier circuit 58 being connected to the output of the subtractor circuit 57. The output of the multiplier circuit 58 is further connected to a first operand input of the adder circuit 59, the second operand input of the adder circuit 59 being connected to the first operand input of the subtractor circuit 57. This device enables the operations of the method shown in the steps 23 to 28 to be performed. In accordance with the step 23 or the step 26, the parameters $X_2$ or $R_2$ are applied to the first comparison input of the comparator circuit 61, to be compared with the content $X_{moy\text{-}old}$ of the register 60 and, if their respective value is greater than the content of the register 60, the comparator circuit 61 commands the shunt circuit 62 to apply the time constant $T_m$ to the first operand input of the multiplier circuit 58. The multiplier circuit 58 receives, at its second operand input, the result of the subtraction made between the content $X_{moy\text{-}old}$ of the register 60 and the values of the parameters $X_2$ or $R_2$ applied to its first operand input. The result of the multiplications $T_m(X_{moy\text{-}old}-X_2)$ or $T_m(X_{moy\text{-}old}-R_2)$, performed by the multipler circuit 58, are applied to the first operand input of the adder circuit 59, to be added to the parameters $X_2$ or $R_2$, applied to its second operand input. The result of the addition performed by the adder circuit 69 is then transferred to within the register 60. However if, at the steps 23 or 26, the values of the parameters $X_2$ or $R_2$ are not greater than the values $X_{moy\text{-}old}$ or $R_{moy\text{-}old}$ found in the register 60, then the shunt circuit 62 is commanded by the comparator circuit 61 to apply the value of the time constant $T_d$ to the first operand input of the multiplier circuit 58. Under these conditions, the computations are conducted similarly to the above description, the value of the time constant $T_m$ being replaced by the value of the time constant $T_d$, in accordance with the relationships indicated in the steps 25 and 28 of the method.

The computations of the speech threshold or noise threshold values ($SX_1$ "speech" and $SX_1$ "noise", $SR_1$ "speech" and $SR_1$ "noise") according to the relationships established in the step 29 of the method, are performed by the circuits described in FIGS. 10A and 10B. The $SX_1$ "speech" or $SR_1$ "speech" thresholds are computed by means of a multiplier circit 63 connected to an adder circuit 64. The multiplier circuit 63 receives, at its first operand input, the parameters $X_{moy}$ or $R_{moy}$ given by the register 60 of FIG. 9, and it has a second operand input to which the parameter a is applied. The result of the multiplication is applied to a first operand input of the adder circuit 64 to be added to the threshold $S_{PH}$·inf which is applied to its second operand input. The output of the adder circuit 64 gives the $SX_1$ "speech" or $SR_1$ "speech" threshold.

Similarly, the $SX_1$ "noise" and/or $SR_1$ "noise" thresholds are computed by means of the multiplier circuit 65 and the adder circuit 66. The first operand input of the multiplier circuit 65 receives the parameters $X_{moy}$ and $R_{moy}$ given by the register 60 of FIG. 9. It has a second operand input to which the parameter b is applied. Its output is connected to a first operand input of the adder circuit 66, the second operand input of which receives the value of the threshold parameter $X_{ph}$·inf. The output of the adder circuit 66 delivers the threshold value $SX_1$ "noise" and $SR_1$ "noise". These threshold values enable a comparison of the parameters $X_1$ and $R_1$ in accordance with the steps 30 to 40 of the method, and according to the graphs shown in FIGS. 11A and 11B. A corresponding comparison device is shown in FIG. 12. This circuit has a set of four comparator circuits referenced 67 to 70, respectively coupled to four inputs of a speech/noise discriminator 71. The comparator circuit 67 compares the parameter $X_1$ with the speech threshold $SX_1$ "speech", the comparator 68 compares the parameter $X_1$ with the threshold $SX_1$ "noise", the comparator 69 compares the parameter $R_1$ with the threshold $SR_1$ "speech" and the comparator 70 compares the parameter $R_1$ with the threshold $SR_1$ "noise". The speech/noise discriminator 71 prepares a vocal activity signal DAV according to the state diagram shown in FIG. 13. This state diagram has two stable states DAV0 and DAV1, and unstable states represented by the letters L1 to L4. The stable state DAV0 is the "noise" state in which the vocal activity detector is placed when there is no speech signal, and the stable state DAV1 is the state in which the vocal activity detector is placed when the signal applied to its input includes a speech signal. When the detector is in the "noise" state DAV0, it goes to the speech state DAV1 only if one of the two parameters $X_1$ and $R_1$ is greater than the corresponding speech threshold, $SX_1$ "speech" or $SR_1$ "speech" in going through the unstable state L1. If not, i.e. if the parameter $X_1$ is below the threshold $SX_1$ "speech" and if the parameter $R_1$ is smaller than the parameter $SR_1$ "speech", then the noise decision is maintained.

By contrast, when the vocal activity detector is in the speech state DAV1, it goes to the noise state DAV1 only if one of the two parameters $X_1$ and $R_1$ is below the corresponding noise threshold, namely if $X_1$ is below the threshold $SX_1$ "noise" and $R_1$ is below the threshold $SR_1$ noise. Under these conditions, it goes through the unstable state L2. This algorithm of the changes in states of the signal DAV is represented in the steps 30 to 39 of FIG. 4. After each change in state of the signal DAV, and after a stage of initialization represented at the step 40, the method returns to the performance of the step 6 of FIG. 1.

Figure 4:
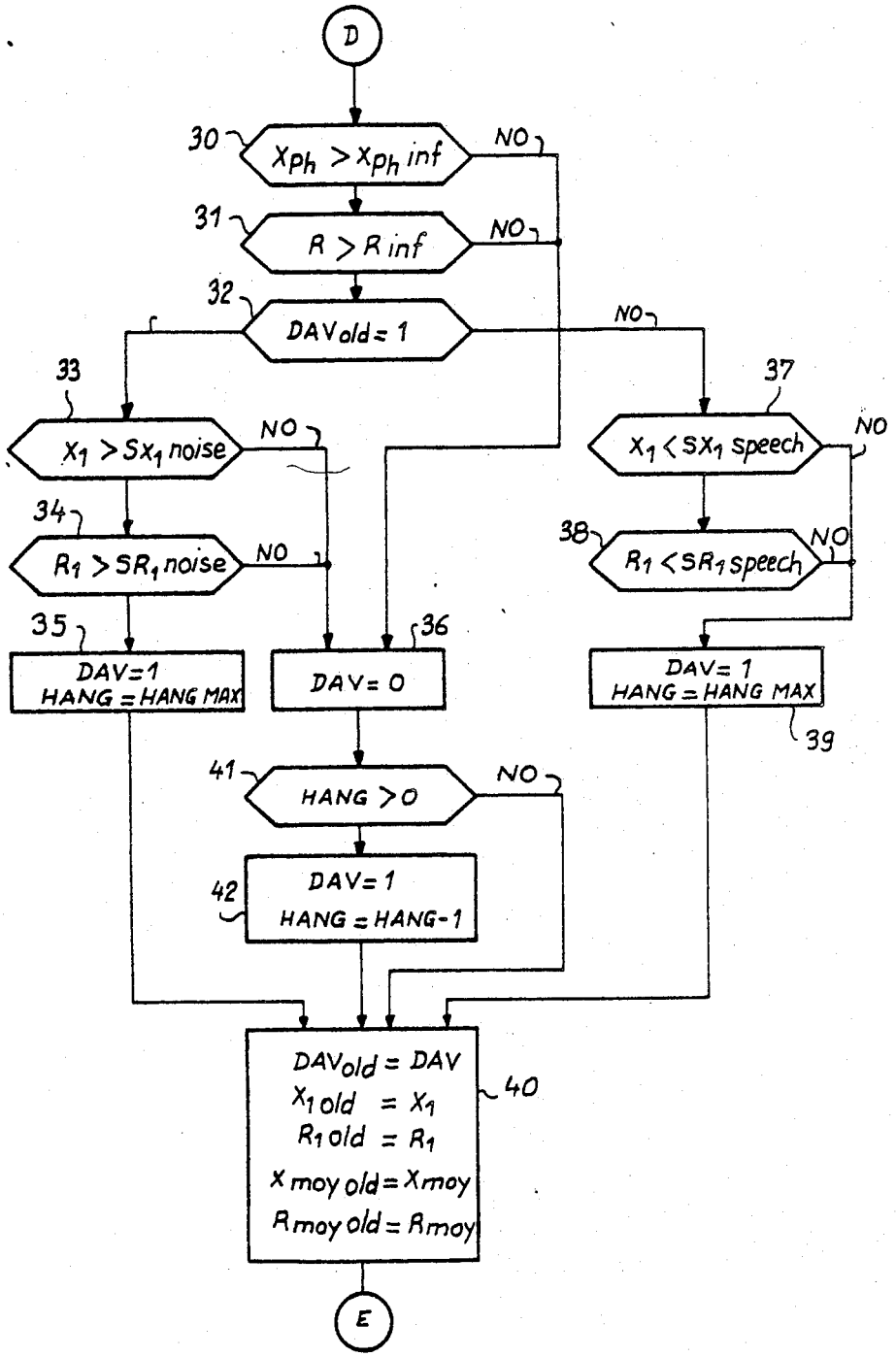

However, as shown in the steps 41 and 42 in the diagram of FIG. 4, the change to the noise state DAV0 is effective only at the end of a certain period, computed by a timing counter (not shown) referenced "Hang", which is loaded with a maximum count value at the steps 35 and 39, whenever a "speech" state DAV1 is decided upon, and the content of which is reduced by one unit whenever the decision DAV0 occurs at the step 36. This makes it possible to avoid systematically going into the "noise" state during the gaps in speech by the speaker or cutting off the end of a word if it has low energy.

It is quite clear that the example of implementation of the method according to the invention is not restricted to the device that has just been described, and that it can equally well be implemented by means of a structure comprising computation means with microprograms recorded, for example, in read-only memories.

What is claimed is:

1. A method for the detection of a vocal signal in a signal that includes noise, said method comprising the steps of:

cutting up the signal into frames;

sampling each frame to obtain a digital signal comprising a determined number n of samples;

preemphasizing the digital signal to obtain a pre-emphasized digital signal;

filtering the pre-emphasized digital signal by means of a high-pass digital filter to obtain a filtered digital signal;

measuring, in each frame, a maximum energy of the samples of the pre-emphasized signal and a maximum energy of the samples of the filtered digital signal;

determining an energy ratio R between the maximum energy of the samples of the filtered digital signal and the maximum energy of the samples of the pre-emphasized digital signal;

computing, between two limits, the mean long-term values of the energy of the samples of the filtered signal and of the energy ratio;

computing, on the basis of the mean long-term values, four threshold values, two of them being maximum values, and forming two lower limits of the speech state for the filtered signal and the energy ratio respectively, and two of them being minimum signals, forming two upper limits of the noise state for the filtered signal and the energy ratio respectively, to compare with these threshold values, the maximum energy of the filtered signal and the energy ratio;

deciding on the presence of the vocal signal in the signal that includes noise when one of the maximum energy of the filtered digital signal, or the energy ratio, is respectively greater than their maximum threshold values; and deciding on the absence of a vocal signal in the signal that includes noise when one of the maximum energy of the filtered digital signal, or the energy ratio R, is respectively smaller than their minimum threshold values.

2. A method according to claim 1, wherein the digital signal is pre-emphasized by means of a Z-transform high-pass digital filter, ($H(z)=1.86\ z^1$).

3. A method according to claim 2, wherein the high-pass digital filter has a cut-off frequency of about 1200 Hz.

4. A method according to claim 3, wherein the measurement of the maximum energy in each frame occurs on the sample of maximum amplitude.

5. A method according to claim 4, wherein the determination of the long-term mean value $X_m$ of the maximum value of the energy of the filter is computed by applying, in each current frame, a recurrence relationship of the form:

$$-X_{moy}=T_m \cdot X_{moy\cdot old}+(1-T_m)\cdot X_2$$

if the value of the parameter $X_2$ is greater than the parameter $X_{moy\cdot old}$, or according to a relationship of the form:

$$X_{moy}=T_d \cdot X_{moy\cdot old}+(1-T_d)\cdot X_2$$

if the value of the parameter $X_2$ is smaller than the parameter $X_{moy\cdot old}$, where: the value $X_2$ is equal to the value of the sample $X_{ph}$ of maximum energy in each frame, limited between two threshold values $X_p$·sup and $X_p$·inf, $X_{moy\cdot old}$ is the mean long-term value computed in the preceding frame, and $T_m$ and $T_d$ are the time constants; $T_m$ being a time constant greater than $T_d$.

6. A method according to claim 5, wherein the mean value $R_{moy}$ of the maximum value of the energy ratio R is computed by applying, in each current frame, a recurrence relationship of the form:

$$R_{moy}=T_m \cdot R_{moy\cdot old}+(1-T_m)R_2$$

if the parameter $R_2$ is greater than the parameter $R_{moy\cdot old}$, and according to a relationship of recurrence of the form:

$$R_{moy}=T_d \cdot R_{moy\cdot old}+(1-T_d)R_2$$

if the parameter $R_2$ is smaller than the parameter $R_{moy}$; $R_{moy\cdot old}$ designating the long-term mean energy ratio computed in the preceding frame.

7. A method according to claim 6, wherein the four threshold values are computed in applying the relationships:

$$SX_1 \text{ speech} = a \cdot X_{moy} + X_{ph} \cdot \text{inf}$$

$$SX_1 \text{ noise} = b \cdot X_{moy} + X_{ph} \cdot \text{inf}$$

$$SR_1 \text{ speech} = a \cdot R_{moy} + R \cdot \text{inf}$$

$$SR_1 \text{ noise} = b \cdot R_{moy} + R \cdot inf,$$

the parameters a and b being constants.

8. A method according to claim 7, wherein a=1.8 and b=1.25.

9. A device for detection of a vocal signal in a signal that includes noise, comprising:

first means to compute, in each frame, a ratio between a maximum energy of the pre-emphasized signal and a maximum energy of the filtered digital signal;

second means to compute long-term mean values of the maximum energy of the filtered signal and of an energy ratio between maximum energies of said filtered digital signal and said preemphasized signal;

third means, coupled to the second means, to compute maximum and minimum adaptive threshold values for the filtered digital signal and the energy ratio based on said long term mean values; and decision means coupled to the third means to decide on the presence of a vocal signal in the digital signal by comparing said maximum energies with said threshold values.

10. A device according to claim 9, wherein the first, second, third and decision means are formed by microprogrammed computing means.

11. A device according to claim 10, wherein the microprogrammed computing means are formed by a signal processor.

* * * * *